US009256146B2

(12) United States Patent
Kawamura et al.

(10) Patent No.: US 9,256,146 B2
(45) Date of Patent: Feb. 9, 2016

(54) TONER FOR ELECTROSTATIC IMAGE DEVELOPMENT

(71) Applicant: Konica Minolta, Inc., Tokyo (JP)

(72) Inventors: Takaki Kawamura, Tokyo (JP); Hiroshi Nagasawa, Tokyo (JP); Kaori Matsushima, Tokyo (JP); Masahiro Matsuoka, Tokyo (JP); Aya Shirai, Tokyo (JP); Taiki Amemiya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 52 days.

(21) Appl. No.: 14/215,721

(22) Filed: Mar. 17, 2014

(65) Prior Publication Data

US 2014/0287354 A1 Sep. 25, 2014

(30) Foreign Application Priority Data

Mar. 25, 2013 (JP) ..... 2013-061493

(51) Int. Cl.
*G03G 9/08* (2006.01)
*G03G 9/087* (2006.01)

(52) U.S. Cl.
CPC ..... *G03G 9/0825* (2013.01); *G03G 9/08702* (2013.01); *G03G 9/08711* (2013.01); *G03G 9/08722* (2013.01); *G03G 9/08755* (2013.01); *G03G 9/08791* (2013.01); *G03G 9/08797* (2013.01)

(58) Field of Classification Search
CPC ..... G03G 9/08722; G03G 9/08755
USPC ..... 430/109.3, 109.4
See application file for complete search history.

(56) References Cited

FOREIGN PATENT DOCUMENTS

| | | | |
|---|---|---|---|
| JP | 2001222138 | A | 8/2001 |
| JP | 2011-081355 | A | 4/2011 |
| JP | 2011-197659 | A | 10/2011 |

*Primary Examiner* — Mark A Chapman
(74) *Attorney, Agent, or Firm* — Lucas & Mercanti, LLP

(57) ABSTRACT

Provided is a toner for electrostatic image development, having low-temperature fixability and long-term stable charge property and also having heat-resistant storage stability. The toner for electrostatic image development includes toner particles containing a binder resin. The binder resin has a domain-matrix structure in which a crystalline polyester resin is dispersed as a domain phase in a matrix phase formed of an amorphous vinyl polymer formed using at least a vinyl-based monomer. The amorphous vinyl polymer has a carboxy group concentration of not less than 0.2 mmol/g and not more than 1.0 mmol/g, and the crystalline polyester resin has an ester group concentration of not less than 0.1 mmol/g and not more than 7.1 mmol/g.

8 Claims, No Drawings

TONER FOR ELECTROSTATIC IMAGE DEVELOPMENT

CROSS REFERENCE TO RELATED APPLICATION

This Application claims the priority of Japanese Patent Application No. 2013-061493 filed on Mar. 25, 2013, which is incorporated by reference herein.

TECHNICAL FIELD

The present invention relates to a toner for electrostatic image development that is used for electrophotographic image formation.

BACKGROUND ART

Recently, to achieve higher energy saving in image forming apparatuses of an electrophotographic system, there is a need for a toner for electrostatic image development (hereinafter may be referred to simply as a "toner") that is heat-fixable at lower temperature. Such a toner is required to have higher low-temperature fixability and also have long-term stable charge property so that high quality images can be formed for a long period of time.

For example, Patent Literature 1 discloses a toner containing a crystalline polyester resin as a fixing aid.

However, with such a toner, the following problems occur unless the compatibility between the crystalline polyester resin and a binder resin is taken into consideration. For example, when the compatibility between the crystalline polyester resin and the binder resin daring heat fixation is high, there arises a problem in that heat-resistant storage stability is low because plasticization of the binder resin proceeds before heat fixation. On the ether hand, when the compatibility between the crystalline polyester resin and the hinder resin is low, there arises a problem in that sufficient low-temperature fixability is not obtained. Another problem in this case is that the crystalline polyester resin is separated and exposed at the surface of toner particles to cause a reduction in the charge property of the toner, so that image failures such as a reduction in image density and fogging occur.

Therefore, Patent Literature 2, for example, proposes that the affinity between the binder resin and the crystalline polyester resin and the concentration of ester groups in the crystalline polyester resin are controlled to achieve both the low-temperature fixability and long-term stable charge property simultaneously.

However, Patent Literature 2 has a problem in that, although low-temperature fixability and heat-resistant storage stability acre achieved, the long-term stability of charge property is low. This is because, although the compatibility between the crystalline polyester resin and the binder resin is taken into consideration, the binder resin used in combination with the crystalline polyester resin is also a polyester resin, i.e., resins of the same type are combined, another problem is that it is not possible to completely prevent the crystalline polyester resin from being exposed at the surface because, although the compatibility is controlled, these resins are of the same type.

Patent Literature 3 proposes that a combination of a crystalline polyester resin and a copolymer, obtained from a styrene-based monomer and a (meth)acrylate-based monomer is used as the binder resin. To achieve low-temperature fixability and heat-resistant storage stability simultaneously, the surface of the crystalline polyester resin used as seeds is surrounded by the resin of the same type as of the binder resin. However, there is no study on compatibility to completely prevent the crystalline polyester in the binder resin from being exposed at the surface, and there still arises a problem in that the long-terra stability of charge property is low.

CITATION LIST

Patent Literature

Patent Literature 1: Japanese Patent Application Laid-open No. 2001-222138

Patent Literature 2: Japanese Patent Application Laid-Open No. 2011-81355

Patent Literature 3: Japanese Patent Application Laid-Open No. 2011-197659

SUMMARY OF invention

Technical Problem

The present invention has been made in view of the foregoing circumstances and has as its object the provision of a toner for electrostatic image development that has low-temperature fixability and long-term stable charge property and also has heat-resistant storage stability.

Solution to Problem

In order to achieve at least one of the above-described objects, the toner for electrostatic image development that reflects one aspect of the present invention comprises toner particles containing a binder resin, wherein the binder resin has a domain-matrix structure in which a crystalline polyester resin is dispersed as a domain phase in a matrix phase composed of an amorphous vinyl polymer formed using at least a vinyl-based monomer, wherein the amorphous vinyl polymer has a carboxy group concentration of not less than 0.2 mmol/g and not more than 1.0 mmol/g, and the crystalline polyester resin has an ester group concentration of not less than 0.1 mmol/g and not more than 7.1 mmol/g.

In the above-described toner for electrostatic image development, the amorphous vinyl polymer may preferably have the carboxy group concentration of not less than 0.3 mmol/g and not more than 0.85 mmol/g. The crystalline polyester resin may preferably have the ester group concentration of not less than 3.0 mmol/g and not more than 7.0 mmol/g.

In the above-described toner for electrostatic image development, the mass ratio of the amorphous vinyl polymer to the crystalline polyester resin, which is (the amorphous vinyl polymer/the crystalline polyester resin), may preferably be 97/3 to 60/40.

In the above-described toner for electrostatic image development, the crystalline polyester resin may preferably have a melting point of 40 to 95° C.

In the above-described toner for electrostatic image development, the amorphous vinyl polymer may preferably comprise two types of amorphous vinyl polymers A and H with different carboxy group concentrations, and the toner particles may preferably be obtained by aggregating and fusion-bonding fine particles of the amorphous vinyl polymer A and fine composite particles that are formed of fine particles of the crystalline polyester resin and the amorphous vinyl polymer B adhering to the surface of the fine particles of the crystalline polyester resin.

In the above-described toner for electrostatic image development, the mass ratio of the crystalline polyester resin to the amorphous vinyl polymer B in the fine composite particles, which is (the crystalline polyester resin/the amorphous vinyl polymer B), may preferably be 10/90 to 80/20.

In the above-described toner for electrostatic image development, the amorphous vinyl polymer B in the fine composite particles may preferably have a carboxy group concentration of not less than 0.2 mmol/g and not more than 1.0 mmol/g, and the following relationships (1) and (2) may preferably be satisfied:

$$B1 < A1 \text{ and} \qquad \text{relationship (1)}$$

$$A1 - B1 \leq |0.5| \qquad \text{relationship (2)}$$

where A1 is a carboxy group concentration [mmol/g] in the amorphous vinyl polymer A, and B1 is the carboxy group concentration [mmol/g] in the amorphous vinyl polymer B.

Advantageous Effects of Invention

In the above-described toner for electrostatic image development, the binder resin has a domain-matrix structure, and the carboxy group concentration in the amorphous vinyl polymer constituting the matrix phase and the ester group concentration in the crystalline polyester resin constituting the domain phase fall within respective specific ranges. Therefore, low-temperature fixability and long-term stable charge property are achieved, and simultaneously heat-resistant storage stability is achieved.

DESCRIPTION OF EMBODIMENTS

The present invention will next be described in detail.

Toner:

The toner of the present invention comprises toner particles containing at least a binder resin, and the toner particles may contain additional toner components such as a colorant, a magnetic powder, a parting agent and a charge control agent, as needed. In addition, external additives such as a flowability improver and a cleaning aid may be added to the toner particles.

The toner of the present invention is obtained by a wet production process, such as an emulsion aggregation process, in which the toner is produced in a water-based medium.

Binder Resin:

In the toner of the present, indention, the binder resin contains at least a crystalline polyester resin and an amorphous vinyl polymer. The binder resin has a domain-matrix structure in which the crystalline polyester resin is dispersed as a domain phase in a matrix phase composed of the amorphous vinyl polymer.

The domain-matrix structure is a structure in which the domain phase including closed boundaries (boundaries between the phases) is present in the continuous matrix phase. In the toner of the present invention, the domain-matrix structure means a state in which the crystalline polyester resin is introduced into the amorphous vinyl polymer so as to be immiscible therewith.

This structure can be observed in cross-sectioned toner particles stained with osmium under a transmission electron microscope using a method known per se in the art. When an ultramicrotome is used to cut a slice, the thickness of the slice is set to 100 nm.

Amorphous Vinyl Polymer:

The amorphous vinyl polymer constituting the matrix phase serves as the main component of the binder resin and is formed using at least a vinyl-based monomer.

Specific examples of the amorphous vinyl polymer include acrylic resins and styrene-acrylic copolymers.

The following monomers etc. can be used as the vinyl-based monomer forming the amorphous vinyl polymer. Such vinyl-based monomers may be used either singly or in any combination thereof.

(1) Styrene-Based Monomers

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, derivatives thereof, etc.

(2) (Meth)Acrylate-Based Monomers

Methyl(meth)acrylate, ethyl(meth)acrylate, n-butyl(meth)acrylate, isopropyl(meth)acrylate, isobutyl(meth)acrylate, t-butyl(meth)acrylate, n-octyl(meth)acrylate, 2-ethylhexyl(meth)acrylate, stearyl(meth)acrylate, lauryl(meth)acrylate, phenyl(meth)acrylate, diethylaminoethyl(meth)acrylate, dimethylaminoethyl(meth)acrylate, derivatives thereof, etc.

(3) Vinyl Esters

Vinyl propionate, vinyl acetate, vinyl benzoate, etc.

(4) Vinyl Ethers

Vinyl methyl ether, vinyl ethyl ether, etc.

(5) Vinyl Ketones

Vinyl methyl ketone, vinyl ethyl ketone, vinyl hexyl ketone, etc.

(6) N-Vinyl Compounds

N-vinylcarbazole, N-vinylindole, N-vinylpyrrolidone, etc.

(7) Others

Vinyl compounds such, as vinylnaphthalene and vinylpyridine, derivatives of acrylic acid and methacrylic acid such as acrylonitrile, methacrylonitrile and acrylamide, etc.

The vinyl-based monomer used is preferably a monomer having an ionic leaving group such as a carboxy group, a sulfonate group, or a phosphate group. Specific examples include the following monomers.

As examples of the monomer having a carboxy group, may be mentioned acrylic acid, methacrylic acid, maleic acid, itaconic acid, cinnamic acid, fumaric acid, maleic acid monoalkyl esters and itaconic acid monoalkyl esters. As examples of the monomer having a sulfonate group, may be mentioned styrenesulfonic acid, allyl sulfosuccinic acid and 2-acrylamide-2-methylpropane sulfonic acid. As examples of the monomer having a phosphate group, may be mentioned acidphosphoxyethyl methacrylate.

In the present invention, the monomer having a carboxy group must be used as a vinyl-based monomer, and the ratio of the monomer having a carboxy group to all the vinyl-based monomers is preferably 2 to 7% by mass. If the ratio of the monomer having a carboxy group is excessively high, the amount of water adsorbed on the surface of the toner particles becomes large. In this case, toner blisters may occur, and difference in the amount of charge due to various environment may increase.

In addition, a polyfunctional vinyl may be used as a vinyl-based monomer to allow the amorphous vinyl polymer to have a cross-linked structure. As examples of the polyfunctional vinyl, may be mentioned divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl, glycol diacrylate.

The amorphous vinyl polymer is preferably a styrene-acrylic copolymer resin formed using a styrene-based monomer and a (meth)acrylate-based monomer.

The carboxy group concentration in the amorphous vinyl polymer is not less than 0.2 mmol/g and not more than 1.0 mmol/g, preferably not less than 0.3 mmol/g and not more than 0.61 mmol/g.

The carboxy group concentration is the ratio of carboxy groups in the amorphous vinyl polymer and represents the affinity for water. The larger the value of the carboxy group concentration is, the higher the affinity for water is.

When the carboxy group concentration in the amorphous vinyl polymer falls within the above range, the amorphous vinyl polymer has higher hydrophilicity than the crystalline polyester resin, in relation to the ester group concentration in the crystalline polyester resin, constituting the domain phase described later. Therefore, during production of the toner in a water-based medium, the toner particles are formed with the crystalline polyester resin being dispersed in the interior of the toner particles, i.e., with the crystalline polyester resin being not exposed at the surface of the toner particles or only a very small amount of the crystalline polyester resin being exposed at the surface, while the immiscibility between the amorphous vinyl polymer constituting the matrix phase and the crystalline polyester resin constituting the domain phase is maintained. Therefore, the obtained toner has sufficient low-temperature fixability and heat-resistant storage stability and also has long-term stable charge property.

If the carboxy group concentration in the amorphous vinyl polymer is excessively low, the hydrophilicity of the amorphous vinyl polymer becomes lower than that of the crystalline polyester resin. In this case, during production of the toner in a water-based medium, the toner particles may be formed with the crystalline polyester resin exposed at the surface of the toner particles to be formed, so that the long-term staple charge property may not de obtained in the obtained toner. If the carboxy group concentration in the amorphous vinyl polymer is excessively high, the carboxy group concentration in the resin surrounding the toner particles becomes excessively high during production of the toner, and the amount of water adsorbed on the surface of the toner particles becomes large. In this case, toner blisters may occur, and difference in the amount of charge due to various environment may increase.

In the present invention, the carboxy group concentration is a value computed using the following formula (1);

carboxy group concentration=[the member of moles of carboxy groups/the sum of (the molecular weight of each vinyl-based monomer forming the amorphous vinyl polymer×its molar fraction]×1000. Formula (1)

The carboxy group concentration in the amorphous vinyl polymer can be controlled by changing the introduction ratio of the monomer having a carboxy group.

When two or more types of amorphous vinyl polymers with different carboxy group concentrations are used, the carboxy group concentration is the sure total of values obtained by multiplying the carboxy group concentrations of the amorphous vinyl polymers by the respective contents (mass ratios).

The glass transition point (Tg) of the amorphous vinyl polymer is preferably 25 to 60° C., more preferably 40 to 55° C.

When the glass transition point of the amorphous vinyl polymer falls within the above range, sufficient low-temperature fixability and beam-resistant storage stability are achieved simultaneously in a reliable manner.

If the glass transition point of the amorphous vinyl polymer is excessively low, the heat resistance (thermal strength) of the toner deteriorates. In this case, sufficient heat-resistant storage stability and hot offset resistance may not be obtained. If the glass transition point of the amorphous vinyl polymer is excessively high, sufficient love-temperature fixability may not be obtained.

In the present invention, the glass transition point (Tg) of the amorphous vinyl polymer is a value measured using "Diamond DSC" (manufactured by PerkinElmer Co., Ltd.).

The procedure of the measurement will next be described. First, 3.0 mg of a measurement sample (the amorphous vinyl polymer) is sealed in an aluminum-made pan, and the pan is placed in a holder. An empty aluminum-made pan is used as a reference. A heat-cool-heat cycle is performed in the measurement temperature of 0 to 200° C. while the temperature is controlled under the measurement conditions of a temperature increase rate of 10° C./min and a temperature decrease rate of 10° C./min. Analysis is performed using data in the 2nd Heat, and the intersection of the extension of a base line before the rising edge of a first endothermic peak and a tangential line representing the maximum inclination between the rising edge of the first endothermic peak and the top of the peak is used as the glass transition point.

The weight-average molecular weight (Mw) of the amorphous vinyl polymer measured by gel permeation chromatography (GPC) is preferably 10,000 to 40,000.

In the present invention, the molecular weight of the amorphous vinyl polymer measured by gel permeation chromatography (GPC) is a value measured as follows.

The molecular weight is measured using an apparatus "HLC-8120GPC" (manufactured by TOSOH Corporation) and a column "TSKguardcolumn+TSKgel SuperHZM-M (three in series)" (manufactured by TOSOH Corporation) in the flow of tetrahydrofuran (THF) used as a carrier solvent at a flow rate of 0.2 mL/min while the temperature of the column is held at 40° C. The measurement sample (the amorphous vinyl polymer) is dissolved in tetrahydrofuran at a concentration of 1 mg/mL using an ultrasonic disperser. In this case, the dissolving treatment is performed at room temperature for 5 minutes. Next, the obtained solution is treated through a membrane filter having a pore sire of 0.2 μm to obtain a sample solution. 10 μL of the sample solution together with the above-described carrier solvent is injected into the apparatus. Detection is performed using a refractive index detector (RI detector), and the molecular weight distribution of the measurement sample is computed using a calibration curve determined using monodispersed polystyrene standard particles. Ten different types of polystyrene were used for the determination, of the calibration curve.

Crystalline Polyester Resin:

The crystalline polyester resin constituting the domain phase is any known polyester resin obtained by a polycondensation reaction of a divalent or higher carboxylic acid (polyvalent carboxylic acid) and a dihydric or higher alcohol (a polyhydric alcohol) and showing a clear endothermic peak rather than a stepwise endothermic change in differential scanning calorimetry (DSC). Specifically, the clear endothermic peak is an endothermic peak with a half-value width of 15° C. or less in differential scanning calorimetry (DSC) when the measurement is performed at a temperature increase rate of 10° C./min.

The polyvalent carboxylic acid is a compound having two or more carboxy groups in its molecule.

Specific examples of the polyvalent carboxylic acid include: saturated aliphatic dicarboxylic acids such as oxalic acid, malonic acid, succinic acid, adipic acid, sebacic acid, azelaic acid and n-dodecyl succinic acid; alicyclic dicarboxylic acids such as cyclohexane dicarboxylic acid; aromatic dicarboxylic acids such as phthalic acid, isophthalic acid and terephthalic acid; trivalent or higher carboxylic acids such as trimellitic acid and pyromellitic acid; and anhydrides and C1 to C3 alkyl esters of these carboxylic acid compounds.

These may be used, either singly or in any combination thereof.

The polyhydric alcohol is a compound having two or more hydroxy groups in its molecule.

Specific examples of the polyhydric alcohol include aliphatic diols such as 1,2-propanediol, 1,3-propanediol, 1,4-butanediol, 1,5-pentanediol, 1,3-hexanediol, 1,7-heptanediol, 1,8-octanediol, neopentyl glycol and 1,4-butenediol; and trihydric or higher alcohols such as glycerin, pentaerythritol, trimethylolpropane and sorbitol.

These may be used either singly or in any combination thereof.

The ester group concentration in the crystalline polyester resin is not less than 0.1 mmol/g and not more than 7.1 mmol/g, preferably not less than 3.0 mmol/g and not sore than 7.0 mmol/g.

The ester group concentration is the ratio of ester groups (ester bonds) in the crystalline polyester resin and represents the degree of affinity for water. The higher the ester group concentration is, the higher the affinity for water is.

when the ester group concentration in the crystalline polyester resin falls within the above range, the crystalline polyester resin has lower hydrophilicity than the amorphous vinyl polymer, in the relation to the carboxy group concentration in the amorphous vinyl polymer constituting the matrix phase. Therefore, during production of the toner in a water-based medium, the toner particles are formed with the crystalline polyester resin dispersed in the interior of the toner particles, i.e., with the crystalline polyester resin not exposed at the surface of the toner particles to be formed or only a very small amount of the crystalline polyester resin exposed at the surface, while the immiscibility between the amorphous vinyl polymer constituting the matrix phase and the crystalline polyester resin constituting the domain phase is maintained. Therefore, the obtained toner has sufficient low-temperature fixability and heat-resistant storage stability and also has long-term stable charge property.

If the ester group concentration in the crystalline polyester resin is excessively row, the crystalline polyester resin is not well-dispersed and is aggregated during production of the toner in the water-based medium. If the ester group concentration in the crystalline polyester resin is excessively high, the crystalline polyester resin does not exhibit higher hydrophobicity than the amorphous vinyl polymer. In this case, during production of the toner in the water-based medium, the toner particles may be formed with the crystalline polyester resin exposed at the surface of the toner particles to be formed, so that the obtained toner may not have long-term stable charge property.

In the present invention, the ester group concentration is a value computed using the following formula (2):

ester group concentration=[the average of the numbers of moles of portions capable of forming ester groups and included in the polyvalent,carboxylic acid and the polyhydric alcohol forming the crystalline polyester resin/((the sum total of the molecular weight of the polyvalent carboxylic acid and the molecular weight of the polyhydric alcohol)−(the molecular weight of water separated by dehydration polycondensation×the number of moles of ester groups))]×1000 Formula (2)

The ester group concentration in the crystalline polyester resin, can be controlled by changing the types of the monomers.

An example of the computation of the ester group concentration in the crystalline polyester resin is shown below.

A crystalline polyester resin obtained from a polyvalent carboxylic acid represented by the following formula (a) and a polyhydric alcohol represented by the following formula (b) is represented by the following formula (c).

$$HOOC—R^1—COOH \quad \text{Formula (a)}$$

$$HO—R^2—OH \quad \text{Formula (b)}$$

$$—(—OCO—R^1—COO—R^2—)_n— \quad \text{Formula (c)}$$

"The average of the numbers of moles of portions capable of forming ester groups and included in the polyvalent carboxylic acid, and the polyhydric alcohol forming the crystalline polyester resin" is the average of the number of moles of carboxy groups in the polyvalent carboxylic acid forming the crystalline polyester resin and the number of moles of hydroxyl, groups in the polyhydric alcohol forming the crystalline polyester resin. More specifically, this value is the average of the number of moles of carboxy groups in the polyvalent carboxylic acid, of the formula (a), i.e., "2," and the number of moles of hydroxy groups in the polyhydric alcohol of the formula (b), i.e., "2," and is therefore "2."

Let the molecular weight of the polyvalent carboxylic acid of the formula (a) be m1, the molecular weight of the polyhydric alcohol of the formula (b) be m2, and the molecular weight of the crystalline polyester resin of the formula (c) be m3. Then "(the sum total of the molecular weight of the polyvalent, carboxylic acid and the molecular weight of the polyhydric alcohol)−(the molecular weight of water separated by dehydration polycondensation×the number of moles of ester groups)" is (m1+m2)−(18×the average number of moles of ester groups, i.e., "2") and is therefore equal to the molecular weight "m3" of the crystalline polyester resin of the formula (c).

Accordingly, the ester group concentration in the crystalline polyester resin represented by the formula (c) is "2/m3."

When two or more types of polyvalent carboxylic acids are used, the average of the numbers of moles of carboxy groups in the polyvalent carboxylic acids and the average of their molecular weights are used. When two or more types of polyhydric alcohols are used, the average of the numbers of moles of hydroxyl groups in the polyhydric alcohols and the average of their molecular weights are used.

The melting point (Tm) of the crystalline polyester resin is preferably 40 to 95° C., more preferably 50 to 35° C.

When the melting point of the crystalline polyester resin falls within the above range, sufficient low-temperature fixability and high hot offset resistance are obtained.

If the melting point of the crystalline polyester resin is excessively low, the thermal strength of the obtained toner becomes low, so that sufficient heat-resistant storage stability and hot offset resistance may not be obtained. If the melting point of the crystalline polyester resin is excessively high, sufficient low-temperature taxability may not be obtained.

The melting point of the crystalline polyester resin can be controlled by changing the composition of the resin.

In the present invention, the melting point of the crystalline polyester resin is a value measured as follows.

Specifically, the melting point is measured using a differential scanning calorimeter "Diamond DSC" (manufactured by PerkinElmer Co., Ltd.) under measurement conditions (heating-cooling conditions) including, in the following order, a first heating step of heating from 0° C. to 200° C. at a temperature increase rate of 10° C./min, a cooling step of cooling from 200° C. to 0° C. at a cooling rate of 10° C./min, and a second heating step of heating from 0° C. to 200° C. at a temperature increase rate of 10° C./min. The peak top temperature of an endothermic peak originating from the crystalline polyester in a DSC curve obtained in the first heating step in this measurement is used as the melting point. The procedure of the measurement is as follows. 3.0 mg of the measurement sample (the crystalline polyester resin) is sealed in an aluminum-made pan, and the pan is placed in a sample holder of the Diamond DSC. An empty aluminum-made pan is used as a reference.

The weight average molecular weight (Mw) of the crystalline polyester resin measured by gel permeation chromatography (GPC) is preferably 5,000 to 30,000, and its number average molecular weight (Mn) is preferably 1,500 to 25,000.

The molecular weights of the crystalline polyester resin measured by gel permeation chromatography (GPC) are measured in the same manner as described above except that the crystalline polyester resin is used as the measurement sample.

The mass ratio of the amorphous vinyl polymer to the crystalline polyester resin, which is (the amorphous vinyl polymer/the crystalline polyester resin), is preferably 97/3 to 60/40, more preferably 95/5 to 70/30.

When the mass ratio (the amorphous vinyl polymer/the crystalline polyester resin) falls within the above range, the crystalline polyester resin constituting the domain phase is not exposed at the surface of the formed toner particles, or only a small amount of the crystalline polyester resin is exposed, at the surface. In addition, the crystalline polyester resin can be introduced into the toner particles in such an amount that low-temperature fixability can be achieved.

If the mass ratio (the amorphous vinyl polymer/the crystalline polyester resin) is excessively high, i.e., the ratio of the amorphous vinyl polymer is excessively high, a sufficient amount of the crystalline polyester resin cannot be introduced into the toner particles, so that sufficient low-temperature fixability may not be obtained. If the mass ratio (the amorphous vinyl polymer/the crystalline polyester resin) is excessively low, i.e., the ratio of the amorphous vinyl polymer is excessively low, plasticization of the amorphous vinyl polymer proceeds excessively. In this case, sufficient heat-resistant storage stability say not be obtained. Further, the crystalline polyester resin constituting the domain phase may be exposed at the surface of the toner particles. Therefore, long-term stable charge property may not be obtained.

In the present invention, to measure the carboxy group concentration in the amorphous vinyl polymer and the ester group concentration and melting point of the crystalline polyester resin, the respective resins contained in the toner particles must be extracted. More specifically, the respective reins can be extracted from the toner particles as follows.

First, the toner is dissolved in methyl ethyl ketone (MEK) at room temperature (not lower than 20° C. and not higher than 25° C.). In this case, the amorphous vinyl polymer in the toner particles dissolves in MEK at room temperature. Therefore, the components dissolved in MEK include the amorphous vinyl polymer, and the dissolved amorphous vinyl polymer is obtained from a supernatant separated by centrifugation. The solids after centrifugation are heated at 65° C. for 60 minutes and dissolved in tetrahydrofuran (THF). The resultant solution is filtrated through a glass filter at 60° C., and the crystalline polyester resin is obtained from the filtrate. If the temperature decreases during filtration in the above procedure, the crystalline polyester resin precipitates. Accordingly, the procedure should be performed while the temperature is maintained.

The carboxy group concentration in the amorphous vinyl polymer can be determined by, for example, 12C-NMR (nuclear magnetic resonance) measurement using deuteriochloroform. More specifically, peaks of carbon atoms originating from the respective monomers are identified, and the types of monomers and the compositional ratio thereof are specified to compute the carboxy group concentration.

The ester group concentration in the crystalline polyester resin can be determined by hydrolysing the crystalline polyester resin, performing measurement by P-GC/MS, and specifying the types of acid and alcohol monomers to compute the ester group concentration.

In the toner described above, a combination of the amorphous vinyl polymer and the crystalline polyester resin different in affinity for water from the amorphous vinyl polymer is used as the binder resin. Therefore, the amorphous vinyl polymer and the crystalline polyester resin are immiscible with each other during production of the toner and before neat fixation. During heat fixation, the crystalline polyester resin exhibits a plasticizing effect on the amorphous vinyl polymer. However, since no reduction in the glass transit ion temperature of the amorphous vinyl polymer occurs, the toner has low-temperature fixability and also has heat-resistant storage stability.

Since the carboxy group concentration in the amorphous vinyl polymer constituting the matrix phase and the ester group concentration in the crystalline polyester resin constituting the domain phase fall within the respective specific ranges, the amorphous vinyl polymer has a higher affinity for water than the crystalline polyester resin. Therefore, during production of the toner in a water-based medium, the amorphous vinyl polymer surrounds and encapsulates the crystalline polyester resin, so that the toner particles are formed with the crystalline polyester resin dispersed in the interior thereof. Accordingly, no crystalline polyester resin is present on the surface of the obtained toner particles, or early a small amount of crystalline polyester resin is present on the surface, and long-term stable charge property is thereby obtained.

When the amorphous vinyl, polymer and the crystalline polyester resin are immiscible with each other, the affinity therebetween is low. Therefore, the crystalline polyester resin may not be easily encapsulated by the amorphous vinyl polymer during production of the toner.

Accordingly, in the present invention, it is preferable to use two types of amorphous vinyl polymers A and B with different carboxy group concentrations as the amorphous vinyl polymer. More specifically, fine composite particles composed or fine particles of the crystalline polyester resin (hereinafter may be referred to as "fine crystalline polyester resin particles") and the vinyl polymer B (hereinafter may be referred to as "coating resin") adhering to the surface thereof are prepared. Then the fine composite particles and fine particles of the amorphous vinyl polymer A (hereinafter may be referred to as a "main resin") are aggregated and fusion-bonded to for/a the toner particles. In this case, the chemical composition of the amorphous vinyl polymer A (main resin) is close to the chemical composition of the amorphous vinyl polymer B (coating resin) adhering to the surface of the fine crystalline polyester resin particles. Therefore, a high affinity is obtained, and the crystalline polyester resin can be easily introduced into the amorphous vinyl polymers.

A production process of the fine composite particles will next be specifically described.

The fine composite particles can be produced by using, for example, a seed polymerization method. More specifically, the fine crystalline polyester resin particles are used as seeds, and the vinyl-based monomer is seed-polymerized on the surface of the fine crystalline polyester resin particles, whereby fine composite particles with the amorphous vinyl polymer B adhering to the surface of the fine crystalline polyester resin particles are obtained.

In the toner of the present invention, it is preferable that the amorphous vinyl polymer A (main resin) and the amorphous vinyl polymer B (coating resin) adhering to the surface of the fine crystalline polyester resin particles have the same composition, i.e., are formed using the same type of vinyl-based monomer. As described above, when the amorphous vinyl polymer A and the amorphous vinyl polymer B have the same composition, the affinity between the amorphous vinyl polymer A and the amorphous vinyl polymer B can be increased, so that the crystalline polyester resin can be more efficiently introduced into the amorphous vinyl polymers during production of the tonner.

In the fine composite particles, the mass ratio of the crystalline polyester resin used as the seed, resin and the amorphous vinyl polymer B (coating resin), which is (the crystalline polyester resin/the amorphous vinyl polymer B), is preferably 10/90 to 80/20, more preferably 50/50 to 80/20.

When the mass ratio (the crystalline polyester resin/the amorphous vinyl polymer B) falls within the above range, a sufficient amount of the amorphous vinyl polymer B adheres to the surface of the fine crystalline polyester resin particles, and the obtained fine composite particles can form a favorable core-shell structure.

In the fine composite particles, it is preferable that the surface of the flue crystalline polyester resin particles used as the seeds is fully coated with the amorphous vinyl polymer B. However, only part of the surface of the fine crystalline polyester resin particles may be coated with the amorphous vinyl polymer B.

In the amorphous vinyl polymer B, the carboxy group concentration B1 is preferably not less than 0.2 mmol/g and not more than 1.0 mmol/g, more preferably not less than 0.3 mmol/g and not more than 0.85 mmol/g.

Preferably, the carboxy group concentration A1 in the amorphous vinyl polymer it and the carboxy group concentration B1 in the amorphous vinyl polymer B satisfy the following relationships (1) and (2):

$$B1 < A1, \text{ and} \qquad \text{relationship (1)}$$

$$A1 - B1 \leq |0.5|. \qquad \text{relationship (2)}$$

When the carboxy group concentration A1 in the amorphous vinyl polymer A and the carboxy group concentration B1 in the amorphous vinyl polymer B satisfy the above relationships (1) and (2), the hydrophilicity of the amorphous vinyl polymer A is close to the hydrophilicity of the amorphous vinyl polymer B. However, since the hydrophilicity of the amorphous vinyl polymer A is higher, toner particles are forced, during production of the toner in a water-based medium while the fine composite particles are efficiently encapsulated in fine particles of the amorphous vinyl polymer A (main resin). Therefore, the obtained toner has higher row-temperature f inability and heat-resistant storage stability and also has sufficient long-term stable charge property.

If the carboxy group concentration A1 in the amorphous vinyl polymer A is not higher than the carboxy group concentration B1 in the amorphous vinyl polymer B (B1≥A1), toner particles may be formed with the fine composite particles exposed at the surface of the toner particles during production of the toner in the water-based medium, so that the obtained toner may not have sufficient long-term stable charge property.

If the difference between the carboxy group concentration A1 in the amorphous vinyl polymer A and the carboxy group concentration B1 in the amorphous vinyl polymer B is larger than 0.5, the affinity between the amorphous vinyl polymer A and the amorphous vinyl polymer B is not sufficient, so that the fine composite particles may not be efficiently encapsulated in the fine particles of the amorphous vinyl polymer A during production of the toner in the water-based medium.

In the toner of the present invention, the binder resin may contain an additional resin other than the amorphous vinyl polymer constituting the matrix phase and the crystalline polyester resin constituting the domain phase.

Colorant:

In the toner of the present invention, when the toner particles are configured to contain a colorant, the colorant may be contained in any of the matrix phase and the domain phase. From the viewpoint of the dispersibility of the colorant, it is preferable that the colorant is contained in the matrix phase.

Examples of the carbon black include channel black, furnace black, acetylene black, thermal black and lamp black. Examples of the black iron oxide include magnetite, hematite and iron titanium trioxide.

Examples of the dye include C.I. Solvent Red: 1, 49, 52, 55, 63, 111 and 122, C.I. Solvent Yellow: 19, 44, 77, 79, 81, 82, 93, 98, 103, 104, 112 and 162 and C.I. Solvent Blue: 25, 36, 60, 70, 93 and 95.

Examples of the pigment include C.I. Pigment Red: 5, 48:1, 48:3, 53:1, 57:1, 81:4, 122, 139, 144, 149, 150, 166, 177, 178, 222, 238 and 259, C.I. Pigment Orange: 31 and 43, C.I. Pigment Yellow: 14, 17, 74, 93, 94, 138, 155, 156, 153, 180 and 185, C.I. Pigment Green: 7 and C.I. Pigment Blue: 15:3 and 60.

As a colorant for obtaining a toner of each color, colorants for each color may be used either singly or in any combination thereof.

The content of the colorant in the toner particles is preferably 1 to 10% by mass, sore preferably 2 to 3% by mass. If the content of the colorant is excessively small, the toner obtained may not have the desired coloring power. If the content of the colorant is excessively large, the colorant may be separated or adhere to a carrier etc., and this user affect charge property.

Parting Agent:

In the toner of the present invention, when the toner particles are configured to contain a parting agent, the parting agent may be contained in any of the matrix phase and the domain phase. From the viewpoint of exudation of the parting agent to the surface of the particles during fixation, it is preferable that the parting agent is contained in the matrix phase.

A wax may be used as the parting agent, and any of polyolefin-based waxes such as low-molecular weight polypropylene wax, low-molecular weight polyethylene wax, oxidized-type polypropylene wax and oxidized-type polyethylene wax and ester-based waxes such as behenyl behenate can be particularly preferably used.

Specific examples of the wax include: polyolefin waxes such as polyethylene wax and polypropylene wax; branched chain hydrocarbon waxes such as microcrystalline wax; long chain hydrocarbon-based waxes such as paraffin wax and Sasol wax; dialkyl ketone-based waxes such as distearyl ketone; ester-based waxes such as carnauba wax, montan wax, behenyl behenate, trimethylolpropane tribehenate, pentaerythritol tetrabehenate, pentaerythritol diacetate dibehenate, glycerin tribehenate, 1,18-octadecanediol diacetate, tristearyl trimellitate and distearyl maleate; and amide-based waxes such as ethylenediamine behenylamide and tristearyl trimellitate amide.

Of these, a wax having low melting point, i.e., a melting point of 40 to 90° C., is preferably used from the viewpoint of releasability during low-temperature fixation.

The content of the parting agent in the toner particles is preferably 1 to 20% by mass, more preferably 5 to 20% by mass. When the content of the parting agent in the toner particles falls within the above range, releasability and fixability can be achieved simultaneously in a reliable manner.

Charge Control Agent:

In the toner of the present invention, when the toner particles are configured to contain a charge control agent, the charge control agent may foe contained in any of the matrix phase and the domain phase. From the viewpoint of the dispersibility of the charge control agent, it is preferable that the charge control agent is contained in the matrix phase.

The content of the charge control agent is generally 0.1 to 10 parts by mass, preferably 0.5 to 5 parts by mass per 100 parts by mass of the finally obtained binder resin.

External Additives:

The toner particles in the toner of the present invention can be used as the toner without adding any additive. However, to improve flowability, charge property, cleanability, etc., external additives such as a flowability improver and a cleaning aid may be added to the toner particles.

A combination of various external additives may be used.

The ratio of the total amount of the external additives added is preferably 0.05 to 5 parts by mass, more preferably 0.1 to 3 parts by mass per 100 parts by mass of the toner particles.

Glass Transition Point of Toner

The toner of the present invention, has a glass transition point (Tg) of preferably 25 to 50° C., more preferably 35 to 55° C.

When the glass transition point of the toner of the present invention falls within the above range, sufficient low-temperature fixability and heat-resistant storage stability are obtained simultaneously in a reliable manner. If the glass transition point of the tonner is excessively low, the heat resistance (thermal strength) of the toner deteriorates. In this case, sufficient heat-resistant storage stability and hot offset resistance may not be obtained. If the glass transition point of the toner is excessively high, sufficient low-temperature fixability may not be obtained.

The glass transition point of the toner is measured in the same manner as described above except that the toner is used as the measurement sample.

Particle Diameter of Toner:

In the toner of the present invention, the average particle diameter, for example, the volume-based median diameter, is preferably 3 to 8 μm, more preferably 5 to 8 μm. The average particle diameter can be controlled by changing the concentration of an aggregating agent used for production of the toner, the added amount of an organic solvent, fusion-bonding time, the chemical composition of the binder resin, etc.

When the volume-bused median diameter falls within the above range, a fine dot image of 1200 dpi can be faithfully reproduced.

The volume-based median, diameter of the toner is measured and computed using a measuring device composed of "Multisizer 3" (manufactured by Beckman Coulter, Inc.) and a computer system connected thereto and equipped with data processing software "Software V3.51," More specifically, 0.02 g of a measurement sample (the toner) is added to 20 mL of a surfactant solution (a surfactant solution used for the purpose of dispersing the toner particles and prepared, for example, by diluting a neutral detergent containing a surfactant component ten-fold with pare water) and is left to stand. The obtained solution is subjected to ultrasonic dispersion treatment for 1 minute to prepare a dispersion of the toner. This toner dispersion is added with a pipette to a beaker containing "ISOTON II" (manufactured by Beckman Coulter, Inc.) and held in a sample stand until the concentration displayed in the measuring device reaches 8%. By adjusting the concentration, a reproducible measurement value can be obtained. In the measuring device, the number of particles to be counted is set to 25,000, and the diameter of an aperture is set to 100 μm. The range of measurement, a 2 to 60 μm range, is divided into 256 sections, and a frequency value in each section is computed. The particle size when a cumulative volume fraction cumulated from the large-diameter side reaches 50% is used as the volume-based median diameter.

Average Circularity of Toner:

In the toner of the present invention, the average circularity of the toner particles included in the toner is preferably 0.930 to 1.000, more preferably 0.950 to 0.995 from the viewpoint of stability of charge property surd low-temperature fixability.

When the average circularity falls within the above range, each of the toner particles is less likely to be broken. Therefore, contamination of a triboelectrifying member is suppressed, so that the charge property of the toner are stabilized. In addition, the qualify of a formed image becomes high.

The average circularity of the toner is a value measured using "FPIA-2100" (manufacture Sysmex Corporation). More specifically, a measurement sample (the toner) is left to stand in a surfactant-containing aqueous solution and then subjected to ultrasonic dispersion treatment for 1 minute to disperse the toner. Then images of the toner are taken using the "FPIA-2100" (manufacture by Sysmex Corporation) in an HPF (high-power field) measurement mode at an appropriate concentration in which, the number of particles detected in the HPF mode is 3,000 to 10,000. The circularity of each of the particles is computed using the following formula (y). The computed circularity values are summed up, and the sum total is divided by the total number of toner particles to compute the average circularity. When the number of particles detected in the HPF mode falls within the above range, reproducibility is obtained.

circularity=(the circumferential length of a circle having the same area as the projected area of a particle image)/(the circumferential length of the projected particle image) Formula (y)

Developer:

The toner of the present invention can be used as a magnetic or non-magnetic one-component developer or seas be mixed with a carrier to be used as a two-component developer. When the toner is used as a two-component developer, the carrier used may be magnetic particles of a publicly known material such as a metal, for example, iron, ferrite or magnetite, or an alloy of any of these metals with a metal such as aluminum or lead. Ferrite particles are particularly preferred. The carrier used may be a coated carrier prepared by coating the surface of magnetic particles with a coating agent such as a ream or a dispersion-type carrier prepared by dispersing a fine magnetic powder in a binder resin.

The volume-based median diameter of the carrier is preferably 20 to 100 gap more preferably 25 to 80 μm. A representative example of the device used to measure the volume-based median diameter of the carrier is a laser diffraction-type particle sire distribution measuring device "HELOS" (manufactured by SYMPATEC) equipped with a wet-type disperser.

Production Process of Toner:

As examples of the production process of the toner according to the present invention, may be mentioned a wet production process, such as an emulsion aggregation process, in which the toner is produced in a water-based medium.

In the production process of the toner of the present invention using the emulsion aggregation process, a water-based dispersion containing fine particles of the binder resin (hereinafter may be referred to as "fine binder resin particles") dispersed in a water-based medium is mixed with a wafer-based dispersion containing fine particles of the colorant (hereinafter may be referred to as "fine colorant particles"). Then the fine binder resin, particles and the fine colorant particles are aggregated, and heat-fused to form toner particles, whereby the toner is produced.

The fine binder resin particles may have a multilayer structure including two or more layers composed of binder resins with different compositions. The fine binder resin particles having such a structure, for example, a two-layer structure, can be obtained by the following process. A dispersion of resin particles is prepared by polymerization treatment (first polymerization) known per se in the art, and a polymerisation initiator and a polymerizable monomer are added to the dispersion. Then the resultant system, is subjected to polymerization treatment (second polymerization).

A "water-based dispersion" is a dispersion containing a dispersoid (fine particles) dispersed in a water-based medium, acid the water-based medium is a medium, composed mainly of water (50% by mass or more). As a component other than water, may be mentioned an organic solvent soluble in water. Examples of such an organic solvent include methanol, ethanol, isopropanol, fontanel, acetone, methyl ethyl, ketone and tetrahydrofuran. Of these, alcohol-based organic solvents such as methanol, ethanol, isopropanol and butanol that are organic solvents not dissolving the resin are particularly preferred.

Care example of the production process of the toner of the present invention will be described specifically.

The production process includes:

(a) a step of preparing a water-based dispersion containing fine particles of the amorphous vinyl polymer A (hereinafter may be referred to as "fine resin particles (A)") dispersed in a water-based medium;

(b) a step of adding a vinyl-based monomer to a water-based dispersion containing fine particles of the crystalline polyester resin (hereinafter may be referred to as "fine crystalline polyester resin particles") dispersed in a water-based medium and performing seed polymerization of the vinyl-based monomer using the fine crystalline polyester resin particles as seeds to thereby prepare a water-based dispersion containing dispersed therein fine composite particles composed of the fine crystalline polyester resin particles and the amorphous vinyl polymer B adhering to the surface of the fine crystalline polyester resin particles;

(c) a step of preparing a wafer-based dispersion containing fine colorant particles dispersed in a water-based medium;

(d) a step of aggregating and fusion-bonding the fine resin particles (A), the fine composite particles and the fine colorant particles in a water-based medium to form associated particles;

(e) a step of aging the associated particles using thermal energy to control their shape, whereby toner particles are obtained;

(f) a step of cooling the dispersion of the toner particles;

(g) a step of separating the toner particles from the water-based medium by filtration to remove the surfactant etc. from the toner particles;

(h) a step of drying the washed toner particles; and (i) an optional step of adding external additives to the dried toner particles, as needed.

(a) Step of Preparing Water-Based Dispersion of Fine Resin Particles (A)

In this step, the water-based dispersion of the fine resin particles (A) composed of the amorphous vinyl polymer A is prepared.

The water-based dispersion of the fires resin particles (A) can be prepared by a miniemulsion polymerization process using a vinyl-based monomer for obtaining the amorphous vinyl polymer A. More specifically, for example, the vinyl-based monomer is added to a water-based medium containing a surfactant, and mechanical energy is applied thereto to form liquid droplets. Then a polymerization reaction is allowed to proceed in the liquid droplets via radicals from the water soluble radical polymerisation initiator. The liquid droplets may contain an oil-soluble polymerization initiator. The water-based dispersion of the fine resin particles (A) composed of the amorphous vinyl polymer a can thereby be prepared.

Surfactant:

The surfactant used in this step may be any of various publicly known surfactants such as anionic surfactants, cationic surfactants and nonionic surfactants.

Polymerization Initiator:

The polymerization initiator used in this step may be any of various publicly known polymerization initiators. Specific preferred examples of the polymerisation initiator include persulfates (for example, potassium persulfate and ammonium persulfate). In addition, any of azo-based compounds (for example, 4,4'-azobis-4-cyanovaleric acid and salts thereof and 2,2'-azobis(2-amidinopropane)salts), peroxide compounds, and azobisisobutyronitrile may be used.

Chain Transfer Agent:

In this step, any generally used chain transfer agent may be used for the purpose of controlling the molecular weight of the amorphous vinyl polymer A. No particular limitation is imposed on the chain transfer agent, and examples thereof include 2-chloroethanol, mercaptans such as octyl mercaptan, dodecyl mercaptan and t-dodecyl mercaptan, and a styrene dimer.

If necessary, the toner particles according to the present invention may contain, in addition to the binder resin, other internal additives such as a parting agent and a charge control agent. Such internal additives many be introduced info the toner particles by, for example, dissolving or dispersing the internal additives in the solution of the vinyl-based monomer for forming the amorphous vinyl polymer A in advance in this step.

Such internal additives may also be introduced into the toner particles as follows. A dispersion of internal additive particles composed only of the internal additives is prepared separately. Then the internal additive particles are aggregated together with the fine resin particles (A), the fine composite particles, and the fine colorant particles in the aggregating and fusion-bonding step. However, it is preferable to use the method in which the internal additives are introduced in advance in this step.

The average particle diameter, i.e., the volume-based median diameter, of the fine resin particles (A) is preferably within the range of 20 to 400 nm.

In the present invention, the volume-based median diameter of the fine resin particles is a value measured using "Microtrac UPA-150" (manufactured by NTKKISO Co., Ltd.).

(b) Step of Preparing Water-Based Dispersion of Fine Composite Particles

In this step, the water-based dispersion of the fine composite particles is prepared. The fine composite particles are composed of the fine crystalline polyester resin particles and the amorphous vinyl polymer B adhering to the surface of the fine crystalline polyester resin particles and formed using the vinyl-based monomer.

More specifically, the crystalline polyester resin is synthesized. Then the synthesized crystalline polyester resin in a fine particle form is dispersed in a water-based medium to obtain a water-based dispersion containing the fine crystalline polyester resin particles dispersed therein. The vinyl-based monomer and the polymerization initiator are added to this water-based dispersion, and seed polymerization is performed using the fine crystalline polyester resin particles as seeds, whereby the water-based dispersion of the fine composite particles can be prepared.

The water-based dispersion of the fine crystalline polyester resin particles may be prepared as follows. The crystalline polyester resin is dissolved or dispersed in an organic solvent to prepare an oil phase solution, and the oil phase solution is dispersed in a water-based medium by, for example, phase inversion emulsification to form oil droplets with their particle diameter controlled to the desired value. Then the organic solvent is removed.

The amount of the water-based medium used is preferably 50 to 2,000 parts by mass, more preferably 100 to 1,000 parts by mass per 100 parts by mass of the oil phase solution.

For the purpose of improving the dispersion stability of the oil droplets, a surfactant etc. may be added to the water-based medium. Examples of the surfactant include those exemplified in the above step.

The organic solvent used to prepare the oil phase solution is preferably a low-boiling point solvent with low solubility in water, from the viewpoint of ease of removal after formation of the oil droplets. Specific examples of such a solvent include methyl acetate, ethyl acetate, methyl ethyl ketone, methyl isobutyl ketone, toluene and xylene. These solvents may be used either singly or in any combination thereof. The amount of true organic solvent used is generally 1 to 300 parts by mass per 100 parts by mass of the crystalline polyester resin.

Emulsification and dispersion of the oil phase solution may be performed by utilising mechanical energy.

The average particle diameter, i.e., the volume-based median diameter, of the fine crystalline polyester resin particles used as seeds is preferably within the range of 10 to 400 nm.

In the present invention, she volume-based median diameter of the fine crystalline polyester resin particles is a value measured using "Microtrac UPA-150" (manufactured by NKKISO Co., Ltd.).

In the seed polymerization, any commonly used chain transfer agent may be used, for the purpose of controlling the molecular weight of the amorphous vinyl polymer B. The chain transfer agent used may be any of the above-exemplified chain transfer agents.

The polymerization initiator used may be any of the above-exemplified polymerization initiators.

Preferably, the seed polymerization is performed in a state in which the viscosity of the crystalline polyester resin is high. The polymerization temperature during seed polymerization is preferably not higher than a temperature of the melting point of the crystalline polyester resin+20° C., more preferably not higher than a temperature of the melting point+10° C., still more preferably not higher than the melting point.

Preferably, the average particle diameter, i.e., the volume-based median diameter, of the fine composite particles falls within the range of 20 to 400 nm.

In the present invention, the volume-based median diameter of the fine composite particles is a value measured using "Microtrac UPA-150" (manufactured by NIKKISO Co., Ltd.).

(c) Step of Preparing Water-Based Dispersion of Fine Colorant Particles:

This step is an optional step performed as needed when toner particles containing a colorant are desired. In this step, the colorant in a fine particle form is dispersed in a water-based medium to prepare a water-based dispersion of the fine colorant particles.

The water-based dispersion of the fine colorant particles is obtained by dispersing the colorant in a water-based, medium, containing a surfactant at a critical, micelle concentration (CMC) or higher.

The colorant may be dispersed by utilizing mechanical energy, and no particular limitation is imposed on the dispenser used. Preferred examples of the disperses include an ultrasonic disperser, a mechanical homogenizer, pressurizing dispersers such as a Manton-Gaulin homogenizer and a pressure-type homogenizer, and medium-type dispersers such as a sand grinder, a Getzmann mill and a diamond fine mill.

The dispersed fine colorant particles have a volume-based median diameter of preferably 10 to 300 nm f more preferably 100 to 200 nm, particularly preferably 100 to 150 nm.

In the present invention, the volume-based median diameter of the fine colorant particles is a value measured using an electrophoretic light-scattering photometer "ELS-800" (manufactured by Otsuka Electronics Co., Ltd.).

(d) Aggregating and Fusion-Bonding Step:

In this step, the fine resin particles (A), the fine composite particles, the fine colorant particles, and, if necessary, fine particles of other toner components are aggregated and fusion-bonded by heat.

More specifically, an aggregating agent is added at a concentration not lower than a critical aggregation concentration to a water-based dispersion containing the above fine particles dispersed in a water-based medium, and the mixture is heated to a temperature higher than the glass transition points of the amorphous vinyl polymers A and B to aggregate and fusion-bond the fine particles.

Preferably, in this step, after the aggregating agent is added to a water-based medium containing the fine resin particles (A) and the fine colorant particles dispersed therein at a temperature lower than the glass transition points of the amorphous vinyl polymers A and B, the fine composite particles are added without increasing the temperature. Particularly preferably, the fine composite particles are added when the diameter of aggregated particles obtained by aggregation of the fine resin particles (A; and the fine colorant particles becomes ¼ to ½ the diameter of the toner particles to be formed, and then the mixture is heated to a temperature not lower than the glass transition points of the amorphous vinyl polymers A and B.

By adding the fine composite particles at such timing to subject them to aggregation, the fine composite particles can be encapsulated in the formed toner particles.

The fusion-bonding temperature for fusion-bonding the fine resin particles (A) and the fine composite particles may be a temperature not lower than the glass transition points of the amorphous vinyl polymers A and B. Particularly, the fusion-bonding temperature is (the glass transition points of the amorphous vinyl polymers A and B+10° C.) to (the glass transition points of the amorphous vinyl polymers A and B+50° C.), particularly preferably (the glass transition points of the amorphous vinyl polymers A and B+15° C.) to (the glass transition points of the amorphous vinyl polymers A and B+40° C.).

Aggregating Agent:

No particular limitation is imposed en the aggregating agent used in this step. An aggregating agent selected from metal salts such as salts of alkali metals and salts of alkaline-earth metals is preferably used. Examples of the metal salts include: salts of monovalent metals such as sodium, potassium and lithium; salts of divalent metals such as calcium, magnesium, manganese and copper; and salts of trivalent metals such as iron and aluminum. Specific examples of the metal salts include sodium chloride, potassium chloride, lithium chloride, calcium chloride, magnesium chloride, zinc chloride, copper sulfate, magnesium sulfate and manganese sulfate. Of these, salts of divalent metals are particularly preferably used because only a small, amount, of such a salt allows aggregation to proceed. These may be used either singly or in any combination thereof.

(e) Aging Step:

This step is performed as needed. In the aging step, aging treatment is performed to age the associated particles obtained in the aggregating-fusion bonding step through thermal energy until the desired shape is obtained, whereby toner particles are formed.

More specifically, the aging treatment is performed by heating and stirring the system containing the associated particles dispersed therein. In the aging treatment, the heating temperature, stirring rate, heating time, etc. are controlled so that the associated particles have the desired circularity.

(f) Cooling Step:

In this step, the dispersion of the toner particles is subjected to cooling treatment. Preferably, the cooling treatment is performed under the condition of a cooling rate of 1 to 20° C./min. No particular limitation is imposed on the specific method for cooling treatment. Examples of the method include a cooling method, in which a coolant is introduced from the outside of a reaction container and a cooling method in which cold water is directly introduced, into the reaction system.

(g) Filtration and Washing Step:

In this step, the cooled dispersion of the toner particles is subjected to solid-liquid separation to separate the toner particles therefrom, and a toner cake obtained by solid-liquid separation (cake-like wet aggregates of the associated particles) is washed to remove adhering materials such as the surfactant and the aggregating agent.

No particular limitation as imposed on the solid-liquid separation method, and any of a centrifugation method, a vacuum filtration method using, for example, a suction funnel, and a filtration method using, for example, a filter press may be used. Preferably, washing is performed with water until the electric conductivity of the filtrate becomes 10 μS/cm.

(h) Drying Step:

In this step, the toner cake subjected to washing treatment is dried. This step may be performed according to a general drying step used in a publicly known production process of toner particles.

Specific examples of the dryer used, to dry the toner cane include a spray dryer, a vacuum freeze dryer, and a vacuum dryer. Preferably, any of a stationary shelf dryer, a movable shelf dryer, a fluidized-bed dryer, a rotary dryer and a stirring dryer is used.

The content of water in the dried toner particles is preferably not higher than 5% by, more preferably not higher than 2% by mass. When the dried toner particles are aggregated together through weak interparticle attractive force, the aggregates may be subjected to pulverization treatment. The pulverizer used may be a mechanical pulverizer such as a jet mill, a Henschel mixer, a coffee mill or a food processor.

(i) Step of Adding External Additives:

This step is an optional step performed as needed when external additives are added to the toner particles.

The above toner particles can be used as a toner without adding any additive. However, the toner particles may be used with external additives such as a flowability improver and a cleaning aid added thereto, in order to improve flowability, charge property, cleanability, etc.

A combination of various external additives may be used.

The total amount of the external additives added is preferably 0.05 to 5 parts by mass, more preferably 0.1 to 3 parts by mass per 100 parts by mass of the toner particles.

The mixer used for the external additives may be a mechanical mixer such as a Henschel mixer or a coffee mill.

In the above toner, the binder resin has a domain-matrix structure, and the carboxy group concentration in the amorphous vinyl polymer constituting the matrix phase surd the ester group concentration in the crystalline polyester resin constituting the domain phase are within the respective specific ranges. Therefore, the toner has low-temperature fixability and long-term stable charge property and also has heat-resistant storage stability.

The embodiment of the present invention has been specifically described. However, the embodiment of the present invention is not limited to the example described above, and various modifications can be made thereto.

For example, the toner of the present invention may comprise toner particles having a core-shell structure. These toner particles are composed of core particles containing the binder resin and a shell layer coating the outer circumferential surface thereof and formed of a shell resin.

In the toner having the shell layer formed thereon, the crystalline polyester resin constituting the domain phase is not exposed at the surface of the toner particles. Therefore, the reduction in charge property caused by the presence of the crystalline polyester resin on the surface of the toner particles can be further suppressed.

The "core-shell structure" includes not only a form in which the core particles are fully coated with the shell layer but also a form in which the core particles are part tally coated with the shell layer. Part of the shell resin constituting the shell layer may form domains in the core particles. In addition, the shell layer may have a multilayer structure including two or more layers formed of resins with different compositions.

EXAMPLES

Specific Examples of the present invention will next be described, but the present invention is not limited thereto.

The volume-based median diameters of the fine resin particles, fine colorant particles, fine crystalline polyester resin particles and fine composite particles were measured in the manner described above, and the molecular weights of the fine resin particles and crystalline polyester resin were measured in the manner described above.

The glass transition points (Tg) of the fine resin particles and toner and the melt leg point of the crystalline polyester resin were measured in the manners described above.

Preparation Example 1 of Water-Based Dispersion of Fine Resin Particles

First Polymerization:

A 5 L reaction container equipped with a stirrer, a temperature sensor, a condenser tube and a nitrogen introduction device was charged with a solution, prepared, by dissolving 8 g of sodium dodecyl sulfate in 3 L of ion exchanged water, and the temperature inside the container was increased to 80° C. while the mixture was stirred at a stirring rate of 230 rpm under nitrogen flow. Then a solution prepared by dissolving 10 g of potassium persulfate in 200 g of ion exchanged water was added, and the temperature of the mixture was again increased to 80° C. A monomer mixture solution containing 480 g of styrene, 250 g of n-butyl acrylate and 68 g of methacrylic acid was added dropwise over one hour. The resultant mixture vats heated and stirred at 80° C. for 2 hours to polymerize the monomers, whereby a water-based dispersion [a1] containing fine resin particles [a1] dispersed therein was prepared.

Second Polymerization:

A 5 L reaction container equipped with a stirrer, a temperature sensor, a condenser tube and a nitrogen introduction device was charged with a solution prepared by dissolving 7 g of sodium polyoxyethylene (2) dodecyl ether sulfate in 800 mL of ion exchanged water, and the solution was heated to 98° C. Then 260 g of the above fine resin particles [a1] and a monomer mixture solution prepared at 90° C. by dissolving and mixing 137 g of styrene, 70 g of n-butyl acrylate, 1.0 g of n-octyl-3-mercaptopropionate and 190 g of a parting agent (behenic acid behenate (melting point: 73° C.)) were added to the heated solution. These components were mixed and dispersed for 1 hour using a mechanical disperser having a circulation path "CLEARMIX" (manufactured by M Technique Co., Ltd.) to prepare a dispersion containing emulsified particles (oil droplets).

Then a polymerization initiator solution prepared by dissolving 6 g of potassium persulfate in 260 mL ion exchanged water was added to the obtained dispersion. The resultant system was heated and stirred at 82° C. for 1 hour to perform polymerization, and a water-based dispersion [a2] containing fine resin particles [a2] dispersed therein was thereby prepared.

Third Polymerization:

A solution prepared by dissolving 11 g of potassium persulfate in 400 mL of ion exchanged water was added to the water-based dispersion [a2], and a monomer, mixture solution containing 241 g of styrene, 78 g of n-butyl acrylate, 28 g of methacrylic acid, 28 g of methyl methacrylate and 6 g of n-octyl-3-mercaptopropionate was added dropwise ever 1 hour under a temperature condition of 82° C. After completion of dropwise addition, the mixture was heated and stirred for 2 hours to perform polymerization and then cooled to 28° C. to thereby prepare a water-based dispersion [A1] of fine resin particles formed of an amorphous vinyl polymer.

The fine resin particles [A1] in the water-based dispersion [A1] had a volume-based median diameter of 220 nm, a weight average molecular weight (Mw) of 35,000, and a glass transition temperature (Tg) of 52° C.

Preparation Examples 2 to 7 of Water-Based Dispersion of Fine Resin Particles Wafer-based dispersions [A2] to [A7] of fine resin particles [A2] to [A7] were prepared in the same manner as in Preparation Example 1 of the wafer-based dispersion of fine resin particles except that the amounts added of the monomers were changed such that each of the resins had one of molar compositions shown in table 1.

TABLE 1

| | Resin composition | | | | | | |
|---|---|---|---|---|---|---|---|
| | Styrene (Molecular weight: 104.15) | n-Butyl acrylate (Molecular weight: 128.17) | Methacrylic acid (Molecular weight: 86.09) | Methyl methacrylate (Molecular weight: 100.10) | Carboxy group concentration(A1) (mmol/g) | Tg (° C.) | Mw |
| | Mole ratio | | | | | | |
| Fine resin particles[A1] | 10.4 | 3.4 | 1.0 | 0.74 | 0.59 | 52 | 35000 |
| Fine resin particles[A2] | 6.3 | 1.8 | 1.0 | 0.4 | 1.00 | 48 | 30000 |
| Fine resin particles[A3] | 33.7 | 9.5 | 1.0 | 2.0 | 0.20 | 56 | 28000 |
| Fine resin particles[A4] | 8.3 | 2.3 | 1.0 | 0.5 | 0.77 | 46 | 22000 |
| Fine resin particles[A5] | 15.3 | 4.3 | 1.0 | 0.9 | 0.43 | 45 | 35000 |
| Fine resin particles[A6] | 10.3 | 2.9 | 0.0 | 0.6 | 0.00 | 50 | 40000 |
| Fine resin particles[A7] | 4.3 | 1.2 | 1.0 | 0.3 | 1.40 | 55 | 27000 |

Synthesis Example 1 of Crystalline Polyester Resin

A 5 L reaction container equipped with a stirrer, a temperature sensor, a condenser tube and a nitrogen introduction device was charged with 300 parts by mass or a polyvalent carboxylic acid, i.e., sebacic acid (molecular weight: 202.25) and 170 parts by mass of a polyhydric alcohol, i.e., 1,6-hexanediol (molecular weight: 118.17). While the system was stirred, the temperature inside the container was increased to 190° C. over 1 hour. After it was confirmed that the system was uniformly stirred, $Ti(OBu)_4$ used as a catalyst was added in an amount of 0.003% by mass with respect, to the charged amount of the polyvalent carboxylic acid compound. Then, while water generated was evaporated, the internal temperature was increased from 190° C. to 240° C. over 6 hours, and a dehydration condensation reaction was performed continuously under a temperature condition of 240° C. for 6 hours to perform polymerisation, whereby a crystalline polyester resin [C1] was obtained.

The melting point (Tm) of the obtained crystalline polyester resin [C1] was 66.8° C., and its number average molecular weight (Mn) was 6,300.

Synthesis Examples 2 to 6 of Crystalline Polyester Resin

Crystalline polyester resins [C2] to [C6] were synthesized in the same manner as in Synthesis Example 1 of the crystalline polyester resin except that the types and added amounts of the monomers were changed, as shown in TABLE 2.

TABLE 2

| | Polyvalent carboxylic acid | | | Polyhydric alcohol | | | | | |
|---|---|---|---|---|---|---|---|---|---|
| | Type | Molecular weight | Added amount (Parts by mass) | Type | Molecular weight | Added amount (Parts by mass) | Ester group concentration (mmol/g) | Tm (° C.) | Mn |
| Crystalline polyester resin[C1] | Sebacic acid | 202.25 | 300 | 1,6-Hexanediol | 118.17 | 170 | 7.03 | 66.8 | 6300 |
| Crystalline polyester resin[C2] | Dodecanedioic acid | 230.3 | 342 | 1,12-Dodecanediol | 202.33 | 291 | 5.04 | 84.9 | 4300 |
| Crystalline polyester resin[C3] | Sebacic acid | 202.25 | 300 | 1,12-Dodecanediol | 202.33 | 291 | 5.43 | 82.8 | 1500 |
| Crystalline polyester resin[C4] | 1,18-Octadecane dicarboxylic acid | 342.51 | 508 | 1,16-Hexadecanediol | 258.44 | 372 | 3.54 | 78.0 | 6800 |
| Crystalline polyester resin[C5] | Sebacic acid | 202.25 | 300 | 1,8-Octanediol | 146.23 | 210 | 6.40 | 80.0 | 5200 |
| Crystalline polyester resin[C6] | Sebacic acid | 202.25 | 300 | Ethylene glycol | 62.07 | 89 | 8.76 | 75.0 | 13000 |

Preparation Example 1 of Water-Based Dispersion of Fine Crystalline Polyester Resin Particles 30 Parts by mass of the crystalline polyester resin [C1] was melted, and the molten crystalline polyester resin [C1] was transferred to an emulsification dispenser "CAVITRON CD1010" (manufactured by EUROTEC Co., Ltd.) at a transfer rate of 100 parts by mass per minute. At the same time as the transfer of the molten crystalline polyester resin [C1], diluted ammonia water having a concentration of 0.37% by mass and prepared by diluting 70 parts by mass of an ammonia water reagent with ion exchanged water in a water-based solvent tank was transferred to the emulsification disperser at a transfer rate of 0.1 L per minute while the diluted ammonia water was heated at 100° C. in a heat exchanger. The emulsification disperser was operated under the conditions of a rotor rotation speed of 60 Hz and a pressure of 5 kg/cm$^2$ to prepare a water-based dispersion [C1] of fine crystalline polyester resin particles [C1] hating a volume-based median diameter of 200 nm. The solid content in the water-based dispersion [C1] was 30 parts by mass.

Preparation Examples 2 to 6 of Water-Based Dispersion of Fine Crystalline Polyester Resin Particles Water-based dispersions [C2] to [C6] of fine crystalline polyester resin particles [C2] to [C6] were prepared in the same manner as in Preparation Example 1 of the water-based dispersion of the fine crystalline polyester resin particles except that one of crystalline polyester resins [C2] to [C6] was used instead of the crystalline polyester resin [C1].

Preparation Example 1 of Water-Based Dispersion of Fine Composite Particles

A 5 L reaction container equipped with a stirrer, a temperature sensor, a condenser tube and a nitrogen introduction device was charged with 2,000 parts by mass of the water-based dispersion [C1] of the fine crystalline polyester resin particles [C1] and 1,150 parts by mass of ion exchanged water. Then a polymerization initiator solution prepared by dissolving 10.3 parts by mass of potassium persulfate in 210 parts by mass of ion exchanged water was added. Then a monomer mixture solution containing 390 parts by mass of styrene (St), 143 parts by mass of n-butyl acrylate (BA), 27 parts by sass of methacrylic acid (MAA) and 40 parts by mass of methyl methacrylate (MMA) used as vinyl-based monomers forming a coating resin was added dropwise over 2 hours under a temperature condition of 80° C., and the mixture was heated and stirred at 80° C. for 2 hours to perform seed polymerization. After completion of polymerization, the mixture was cooled to 28° C., whereby a water-based dispersion [S1] of fine composite particles [S1] encapsulating the fine crystalline polyester resin particles [C1] was prepared.

In the water-based, dispersion [S1], the volume-based median diameter of the fine composite particles [S1] was 280 nm.

Preparation Examples 2 to 6 of Water-Based Dispersion of Fine Composite Particles Water-based, dispersions [S2] to [S3] of fine composite particles [S2] to [S8] were prepared in the same manner as in Preparation Example 1 of the water-based dispersion of the fine composite particles except that the added amounts of the monomers were changed such that each of the coating resins had one of molar compositions shown in TABLE 3, that the used type of the seeds (fine crystalline polyester resin particles) was changed as shown in TABLE 3 and that the added amount of the wafer-based dispersion of the seeds was changed such that the mass ratio of the coating resin and the seeds was ear shown in TABLE 3.

TABLE 3

| | Coating resin | | | | | Seeds (Fine crystalline polyester resin particles) | | Content ratio (Mass ratio) | |
|---|---|---|---|---|---|---|---|---|---|
| | Resin composition (Mole ratio) | | | | Carboxy group concentration(B1) | | Ester group concentration | | |
| | St | BA | MAA | MMA | (mmol/g) | No. | (mmol/g) | Seeds | Coating resin |
| Fine composite particles[S1] | 12.1 | 3.4 | 1.0 | 0.7 | 0.54 | C1 | 7.03 | 50 | 50 |
| Fine composite particles[S2] | 6.7 | 1.9 | 1.0 | 0.4 | 0.93 | C2 | 5.04 | 80 | 20 |
| Fine composite particles[S3] | 34.8 | 9.8 | 1.0 | 2.0 | 0.19 | C3 | 5.43 | 70 | 30 |
| Fine composite particles[S4] | 8.5 | 2.4 | 1.0 | 0.5 | 0.75 | C4 | 3.54 | 30 | 70 |
| Fine composite particles[S5] | 16.0 | 4.5 | 1.0 | 0.9 | 0.41 | C5 | 6.40 | 50 | 50 |
| Fine composite particles[S6] | 10.3 | 2.9 | 0.0 | 0.6 | 0.00 | C3 | 5.43 | 50 | 50 |
| Fine composite particles[S7] | 33.7 | 9.5 | 1.0 | 2.0 | 0.20 | C6 | 8.76 | 50 | 50 |
| Fine composite particles[S8] | 10.1 | 2.8 | 1.0 | 0.6 | 0.64 | C1 | 7.03 | 8 | 92 |

Preparation Example 1 of Water-Based, Dispersion, of Fine Colorant Particles 90 Parts by weight of sodium polyoxyethylene-5-dodecyl ether sulfate was dissolved in 1,510 parts by mass of ion exchanged water under stirring, 400 Parts by mass of carbon black "REGAL 300" (manufactured by Cabot Corporation) was gradually added to the obtained solution under stirring, and then dispersion treatment was performed using a stirrer "CLEARMIX" (manufactured by M Technique Co., Ltd.; to thereby prepare a water-based dispersion. [Bk] of the fine colorant particles.

The volume-based median diameter of the fine colorant particles in the water-based dispersion [Bk] of the fine colorant particles was measured and found to be 110 nm.

Production Example 1 of Toner

A separable flask equipped with a stirrer, a temperature sensor, a condenser tube and a nitrogen introduction device was charged with 2,500 parts by mass of ion exchanged wafer, 600 parts by mass (in terms of solids) of the water-based dispersion [A1] or the fine resin particles [A1], 300 parts by mass (in terms of solids) of the water-based dispersion [S1] of the fine composite particles [S1] and 500 parts by mass of the water-based dispersion [Bk] of the fine colorant, particles [Bk]. After the temperature of the solution was adjusted to 25° C., an aqueous solution of sodium hydroxide with a concentration of 25% by mass was added to adjust the pH to 10.

Next, an aqueous solution prepared by dissolving 54.3 parts by mass of magnesium chloride hexahydrate in 54.3 parts by mass of ion exchanged water was added, and the temperature of the system was increased to 97° C. to initiate the aggregation reaction of the resin particles and the fine colorant particles.

After the start of the aggregation reaction, sampling was performed at regular intervals to measure the volume-based median diameter of the particles using a particle sire distribution measuring device "Coulter Multisizer 3" (manufactured by Beckman Coulter, Inc.). Aggregation was continued under stirring until the volume-based median diameter became 6.3 μm.

Then an aqueous solution prepared by dissolving 23.0 parts by mass of sodium chloride in 92 parts by mass of ion exchanged water was added. The temperature of the system; was adjusted to 95° C.; and stirring was continued for 4 hours. When the circularity measured using a flow-type particle image analyzer "FPIA-2100" (manufactured by Sysmex) reached 0.946, the system was cooled to 30° C. under the condition of 6° C. to terminate the reaction, whereby a dispersion of toner particles was obtained. The diameter of the cooled toner particles was 6.1 μm, and their circularity was 0.946.

The thus-obtained dispersion of the toner particles was subjected to solid-liquid reparation using a basket-type centrifuge "MARK III TYPE 60×40" (manufactured by Matsumoto Machine Manufacturing Co., Ltd.) to form a wet cake. The wet cake was repeatedly washed and subjected to solid-liquid separation in she basket-type centrifuge until the electric conductivity of the filtrate reached 15 μS/cm. Then air at a temperature of 40° C. and a humidity of 20% RH was blown using a "flash jet dryer" (manufactured by Seishin Enterprise Co., Ltd.) to dry the cake until the water content became 0.5% by mass, and the cake was cooled to 24° C. to thereby obtain toner particles [1].

1% By mass of hydrophobic silica particles and 1.2% by mass of hydrophobic titanium oxide particles were added to the obtained toner particles [1], and these particles were mixed using a Henschel mixer for 20 minutes under the condition of a peripheral speed of a rotary blade of 24 m/s and were caused to pass through a 400 mesh sieve to thereby add the external additives, whereby a toner [1] was obtained.

The glass transition point of the obtained toner [1] was measured and found to be 37° C.

Although the hydrophobic silica particles and the hydrophobic titanium oxide particles were added to the toner [1], the shape and diameter of the toner particles were not changed.

Production Examples 2 to 14 of Toner

Toners [2] to [14] were obtained in the same manner as in Production Example 1 of the toner except that the types of the water-based dispersion [A1] of the fine resin particles [A1]

and the water-based dispersion [S1] of the fine composite particles [S1] were changed as shown in TABLE 4 and that the added amounts of the water-based dispersions were changed such that the mass ratio of the resins was as shown in TABLE 4.

The toner [8] was produced using the water-based dispersion [C2] of the fine crystalline polyester resin particles [C2] instead of the water-based dispersion [S1] of the fine composite particles [S1]. The toner [13] was produced using a water-based dispersion [X] of fine amorphous polyester resin particles [X] described below instead of the water-based dispersion [A1] of the fine resin particles [A1] said using the water-based dispersion [C2] of the fine crystalline polyester resin particles [C2] instead of the water-based dispersion [S1] of the fine composite particles [S1]. The toner [14] was produced without adding the water-based dispersion [S1] of the fine composite particles [S1].

Preparation Example of Water-Based Dispersion of Fine Amorphous Polyester Resin Particles (1) Synthesis of Amorphous Polyester Resin A heat-dried three-neck flask was charged with 525 parts by mass of a 2 mole propylene oxide adduct of bisphenol A, 225 parts by mass of a 2 mole ethylene oxide adduce of bisphenol A, 375 parts by mass of terephthalic acid, 20 parts by mass of fumaric acid, 120 parts by mass of dodecenyl succinic acid (succinic acid 1) including 15% by mole of dodecenyl succinic acid having a branched, structure (the number of carbon atoms in the branched portion: 3), 180 parts by mass of dodecenyl succinic acid (succinic acid 2) including less than 2% by mole of dodecenyl succinic acid having a branched structure (the number of carbon atoms in the branched portion: 3) and 3 parts by mass of dibutyl tin oxide. The air pressure in the container was reduced, by a pressure reducing operation, and nitrogen gas was introduced to form an inert gas atmosphere. Then the mixture was allow to react under mechanical stirring at 230° C. and atmospheric pressure (101.3 kPa) for 10 hours and further react at 8 kPa for 1 hour. The mixture was cooled to 210° C., and 75 parts by mass of trimellitic anhydride was added. The mixture was allowed to react for 1 hour and further react at 8 kPa until softening temperature became 120° C., whereby an amorphous polyester resin [X] was obtained.

(2) Preparation of Water-Based Dispersion of Fine Amorphous Polyester Resin Particles Next, a separable flask was charged with 350 parts by mass of the amorphous polyester resin [X] from which insoluble matter had been removed, 245 parts by mass of methyl ethyl ketone, 70 parts by mass of isopropyl alcohol and 11.2 parts by mass of a 10% by mass aqueous ammonia solution. These components were mixed and dissolved, and then ion exchanged water was added dropwise at 40° C. under stirring using a feed pump at a feeding rate of 8 g/min. After the solution became cloudy, the feeding rate was increased, to 12 g/min for phase inversion, and dropwise addition was stopped when the amount of fed water reached 1,030 parts by mass. Then the solvent was removed under reduced pressure to thereby obtain the water-based dispersion [X] of the fine amorphous polyester resin particles [X].

TABLE 4

| | | | Content ratio (Mass ratio) | | | | Amorphous vinyl polymer (Main resin + coating resin) |
|---|---|---|---|---|---|---|---|
| Toner No. | Water-based dispersion No. of fine resin particles | Water-based dispersion No. of fine composite particles | Main resin | Coating resin | Seed resin | A1 − B1 (mmol/g) | Carboxy group concentration (mmol/g) |
| Toner[1] | A1 | S1 | 70 | 15 | 15 | 0.04 | 0.58 |
| Toner[2] | A2 | S2 | 70 | 6 | 24 | 0.07 | 0.99 |
| Toner[3] | A3 | S3 | 70 | 9 | 21 | 0.01 | 0.20 |
| Toner[4] | A4 | S4 | 80 | 14 | 6 | 0.02 | 0.77 |
| Toner[5] | A5 | S5 | 70 | 15 | 15 | 0.02 | 0.43 |
| Toner[6] | A1 | S6 | 70 | 15 | 15 | 0.59 | 0.49 |
| Toner[7] | A4 | S8 | 37.5 | 57.5 | 5 | 0.13 | 0.69 |
| Toner[8] | A1 | Water-based dispersion [C2] of fine crystalline polyester resin particles [C2] | 85 | 0 | 15 | — | 0.60 |
| Toner[9] | A1 | S2 | 50 | 10 | 40 | −0.34 | 0.66 |
| Toner[10] | A2 | S7 | 70 | 15 | 15 | 0.8 | 0.86 |
| Toner[11] | A6 | S1 | 70 | 15 | 15 | −0.54 | 0.10 |
| Toner[12] | A7 | S1 | 70 | 15 | 15 | 0.86 | 1.25 |
| Toner[13] | Water-based dispersion [X] of fine amorphous polyester resin particles [X] | Water-based dispersion [C2] of fine crystalline polyester resin particles [C2] | 80 | 0 | 20 | — | — |
| Toner[14] | A1 | — | 100 | — | — | — | 0.60 |

Production Examples 1 to 14 of Developer

Developers [1] to [14] were produced by adding a ferrite carrier having at volume-Based median diameter of 60 μm and coated with a silicone resin to each of tire toners [1] to [14] such that the concentration of the toner was 6% and mixing them using a V-type mixer.

(1) Evaluation of Low-Temperature Fixability

A fixation experiment was performed using, as an image forming apparatus, a commercial copier "bizhub PRO C6500" (manufactured by Konica Minolta Business Technologies, Inc.) including fixing means of the thermal roller fixation type that was modified such that the surface temperature of fixation heating rollers could be changed within the range of 120 to 200° C. In the fixation experiment, one of the developers [1] to [14] was installed as the developer, and a solid image with a toner adhesion amount of 8 mg/cm$^2$ was fixed on an A4 high-quality paper sheet in a room temperature-room, humidity environment (temperature: 20° C., humidity: 55% RH). The fixation experiment was repeated at different fixation temperature settings in a manner such that the fixation temperature was increased from 120° C. to 200° C. with an increment of 5° C. In the results of the fixation experiment in which no image contamination due to cold offset was visually observed, the lowest one of the fixation temperatures was evaluated as the lowest fixable temperature. A developer having a lowest fixing temperature not higher than 140° C. was judged as pass. The results are shown in TABLE 5.

(2) Long-Term Stable Charge Property:

A commercial copier "bizhub PRO C6500F" (manufactured by Konica Minolta Business Technologies, Inc.) was used as an image forming apparatus, and one of the developers [1] to [14] was installed as the developer. A text image basing a coverage rate of 10% was printed continuously on 100,000 A4 high quality paper sheets in a high temperature-high, humidity environment (temperature: 30° C., humidity: 85% RH). Then a test image including a white image and a half tone image was printed. Fogging was checked, and image roughness of the halftone image was checked. The results were evaluated using the following evaluation criteria. The results are shown in TABLE 5.

—Evaluation Criteria—

A: No reduction in image density and no fogging were visually observed.

B: A slight reduction in image density and/or slight fogging was observed under a 20× loupe but was practically acceptable.

C: A reduction in image density and/or fogging was visually observed but was practically acceptable.

D: A reduction in image density and fogging were visually observed, and were practically unacceptable.

(3) Heat Resistant Storage Stability;

0.5 g of one of the toners [1] to [14] was placed in a 10 mL glass bottle having an inner diameter of 21 mm, and the glass bottle was closed with a lid. The bottle was shaken using a shaker "Tap Denser KYT-2000" (manufactured by Seishin Enterprise Co., Ltd.) 600 times at room temperature. Then the toner was left to stand in an environment of a temperature of 55° C. and a humidity of 35% RH for 2 hours with the lid removed. Then the toner was placed with care on a 48 meet sieve (aperture: 350 μm) such that the aggregates of the toner were not pulverized, and the sieve was placed on a "powder tester" (manufactured by Hosokawa Micron Group) and secured using a pressing bar and a knob nut. The strength of vibrations was adjusted such that a feed width was 1 mm, and vibrations were applied for 10 seconds. Then the ratio (% by mass) of the toner remaining on the sieve was measured, and the aggregation ratio of the toner was computed rising the following formula (A). The heat-resistant storage stability was evaluated on the basis of the obtained aggregation ratio of the toner. A toner having an aggregation ratio of 20% or less was judged as pass. The results are a (town in TABLE 5.

$$\text{aggregation ratio (\%) of toner} = (\text{mass (g) of toner remaining on sieve})/0.5\ (\text{g}) \times 100 \qquad \text{Formula (A)}$$

TABLE 5

| | Toner No. | Evaluation results: Low-temperature fixability Lowest fixable temperature (° C.) | Long-term stable charge property | Heat resistant storage stability Aggregation ratio (%) |
|---|---|---|---|---|
| Example 1 | 1 | 115 | A | 13.0 |
| Example 2 | 2 | 125 | A | 3.0 |
| Example 3 | 3 | 125 | A | 10.0 |
| Example 4 | 4 | 135 | B | 5.0 |
| Example 5 | 5 | 120 | A | 15.0 |
| Example 6 | 6 | 135 | C | 15.0 |
| Example 7 | 7 | 140 | A | 5.0 |
| Example 8 | 8 | 120 | C | 17.0 |
| Example 9 | 9 | 105 | A | 19.0 |
| Comparative example 1 | 10 | 110 | C | 30.0 |
| Comparative example 2 | 11 | 125 | D | 35.0 |
| Comparative example 3 | 12 | 120 | D | 20.0 |
| Comparative example 4 | 13 | 105 | B | 45.0 |
| Comparative example 5 | 14 | 160 | A | 3.0 |

The invention claimed is:

1. A toner for electrostatic image development, comprising toner particles containing a binder resin, wherein the binder resin has a domain-matrix structure in which a crystalline polyester resin is dispersed as a domain phase in a matrix phase composed of an amorphous vinyl polymer formed using at least a vinyl-based monomer, wherein the amorphous vinyl polymer has a carboxy group concentration of not less than 0.2 mmol/g and not more than 1.0 mmol/g, and the crystalline polyester resin has an ester group concentration of not less than 0.1 mmol/g and not more than 7.1 mmol/g.

2. The toner for electrostatic image development according to claim 1, wherein a mass ratio of the amorphous vinyl polymer to the crystalline polyester resin, which is (the amorphous vinyl polymer/the crystalline polyester resin), is 97/3 to 60/40.

3. The toner for electrostatic image development according to claim 1, wherein the crystalline polyester resin has a melting point of 40 to 95° C.

4. The toner for electrostatic image development according to claim 1, wherein the amorphous vinyl polymer comprises two types of amorphous vinyl polymers A and B with different carboxy group concentrations, and the toner particles are obtained by aggregating and fusion-bonding fine particles of the amorphous vinyl polymer A and fine composite particles that are formed of fins particles of the crystalline polyester reels and the amorphous vinyl polymer B adhering to the surface of the fine particles of the crystalline polyester resin.

5. The toner for electrostatic image development according to claim 4, wherein a mass ratio of the crystalline polyester resin to the amorphous vinyl polymer B in the fine composite particles, which is (the crystalline polyester resin/the amorphous vinyl polymer B), is 10/90 to 80/20.

6. The toner for electrostatic image development according to claim 4, wherein the amorphous vinyl polymer B in the fine composite particles has a carboxy group concentration of not less than 0.2 mmol/g and not more than 1.0 mmol/g, and the following relationships (1) and (2) are satisfied:

$$B1 < A1 \text{ and} \qquad \text{relationship (1)}$$

$$A1 - B1 \leq |0.5| \qquad \text{relationship (2)}$$

where A1 is a carboxy group concentration, [mmol/g] in the amorphous vinyl polymer A, and B1 is the carboxy group concentration [mmol/g] in the amorphous vinyl polymer B.

7. The toner for electrostatic image development according to claim 1, wherein the amorphous vinyl polymer has a carboxy group concentration of not less than 0.3 mmol/g and not more than 0.85 mmol/g.

8. The toner for electrostatic image development according to claim 1, wherein the crystalline polyester resin has the ester group concentration of not less than 3.0 mmol/g and not more than 7.0 mmol/g.

* * * * *